US005826925A

United States Patent [19]

Marx

[11] Patent Number: 5,826,925

[45] Date of Patent: Oct. 27, 1998

[54] DEVICE FOR ALIGNING OBJECTS

[76] Inventor: Donald R. Marx, 9450 Harbor Greens Way, #A-507, Seminole, Fla. 33776

[21] Appl. No.: 726,881

[22] Filed: Oct. 4, 1996

[51] Int. Cl.[6] ..... B25J 1/04

[52] U.S. Cl. ..... 294/1.1; 294/26

[58] Field of Search ..... 294/1.1, 4, 9–17, 294/19.1, 22–27.1, 32, 49, 50.6, 55

[56] References Cited

U.S. PATENT DOCUMENTS

| | | | |
|---|---|---|---|
| 287,727 | 10/1883 | Ross | 294/15 |
| 1,311,618 | 7/1919 | Penn | 294/26 |
| 1,562,034 | 11/1925 | Mieher | 294/26 |
| 1,739,347 | 12/1929 | Benedict | 294/26 |
| 2,429,046 | 10/1947 | Billig | 294/11 |
| 2,541,158 | 2/1951 | Gardiner | 294/12 |
| 3,069,714 | 12/1962 | Chinn | 294/55 X |
| 3,385,625 | 5/1968 | Heines | 294/26 |
| 3,574,380 | 4/1971 | Tague | 294/26 X |
| 4,712,819 | 12/1987 | Pope | 294/151 X |
| 4,831,690 | 5/1989 | Foegen | 294/26 |
| 5,217,272 | 6/1993 | Hsu et al. | 294/1.1 |

*Primary Examiner*—Johnny D. Cherry
*Attorney, Agent, or Firm*—Ronald E. Smith

[57] ABSTRACT

This invention is a device to align objects quickly and efficiently on shelves or display. The device comprises an elongated arm with a handle and extension member in a "C" or "J" configuration. The device is positioned so that the extension member is behind the objects to be aligned, rotated to engage the objects from behind, and, when the device is pulled, move the objects into alignment. The handle or extension member can be movably or pivotably attached at or near the ends of the elongated arm. This device is particularly useful in aligning books and boxes on shelves or display cases. The length of the arm, handle, or extension member can be adjusted, so the device can be used on a variety of different size objects.

1 Claim, 3 Drawing Sheets

DEVICE FOR ALIGNING OBJECTS

FIELD OF INVENTION

This invention relates to a device which may be used to quickly and efficiently align objects on shelves.

DESCRIPTION OF THE PRIOR ART

In libraries and stores an important aspect of presentation of neat and orderly operation is for the books or goods to be uniformly aligned towards the front of the shelf or display space. The age-old method of achieving such alignment is for a library or store employee to reach, through any available opening, behind the objects to be aligned and pull the items to the front by using their hands and fingers. The aligning process is time consuming under the best of conditions. Depending on the depth of the items, free space around the items, and other conditions, such as, whether the employee is having to stand on a step-stool or ladder, the aligning process can become very time consuming.

Often only one or two items need to be aligned, but the free space through which the employee must pass their arm is so small that the attempt to align the items results in disturbing of the items and usually results in having to reshelve substantial number of items.

Sometimes objects are too bulky or deep for a person to reach behind to move, and there are no safe or effective handholds in the front part by which to move the object. Therefore, some means is needed to engage the object from behind and allow the employee to pull the object forward to align it as desired.

Further, objects of one type, or displayed in one section, may be more or less deep than other objects, which slows down the aligning process if more than one employee is required because of these differences.

Although there have been bookends and other devices to assist in holding books and other objects in place once aligned, there is no known device to those skilled in the art which quickly and efficiently aligns books, boxes and other objects. As of this time, Applicant is not aware of any relevant prior art.

SUMMARY OF THE INVENTION

This invention provides a unique device for use in aligning objects, such as, books, on a display shelf or storage unit.

According to the present invention, a device is provided which comprises an elongated arm of predetermined length having a distal end and a proximal end; a handle means disposed at the proximal end of the elongated arm in depending relation from it; extension member means disposed at the distal end of the elongated arm in depending relation from it; and such arm and extension member means being configured to move freely through an annular space about an object to be aligned, so that objects may be moved in the direction of the proximal end of the arm by the action of the extension member being pulled by an externally supplied force acting on the handle means.

However, it is to be understood that the invention is not limited to the details disclosed, but includes all such variations and modifications as fall within the spirit of the invention and the scope of the appended claims.

DETAILED DESCRIPTION OF THE INVENTION

Figure 1:
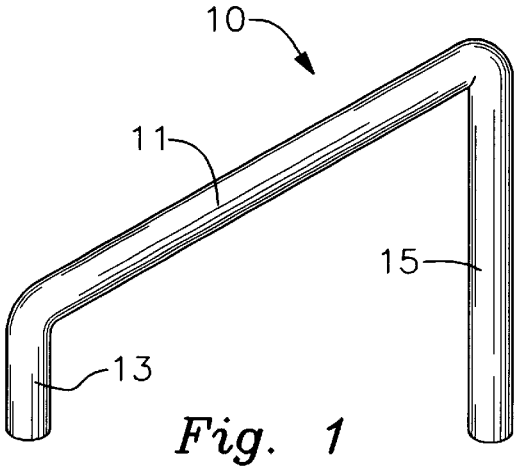
FIG. 1 is a perspective view of the device.

A preferred embodiment of the present invention is shown at FIG. 1. The device 10 includes an elongated arm 11 of a predetermined length, which has a distal end and proximal end. A handle means 13 is disposed at the proximal end of the elongated arm 11 in depending relation to the elongated arm 11. An extension member means 15 is disposed at the distal end of the elongated arm 11 in depending relation to the elongated arm 11. In this embodiment, rigid tubular plastic was used, which was approximately ½ to ¾ inches in diameter. Any material may be used, such as, wood, metal, composites, or synthetic material, which may be either hollow, perforated, or solid. Additionally, the lengths of the handle means 13 and extension member means 15 are not equal with respect to each other, which allows for use of the device 10 on different height objects. However, the handle means 13 and extension member means 15 may be equal with respect to each other.

Figure 2:
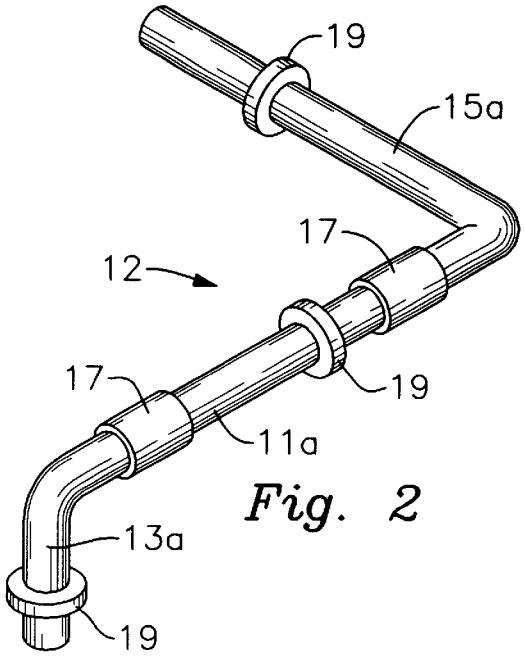
FIG. 2 is a perspective view of the device with non-coplanar handle means and extension member means.

A different embodiment is shown in FIG. 2. In this embodiment, the handle means 13*a* and extension member means 15*a* are not coplanar. The handle means 13*a* and extension member means 15*a* may be in any planar relationship to each other. Additionally, as shown in the FIG. 2 embodiment, the device 12 does not have to be of one piece construction. In this embodiment, the handle means 13*a* is attached at the proximal end of the elongated arm 11*a* by a screw socket sleeve 17. Also, the extension member means 15*a* is attached at the distal end of the elongated arm 11*a* by a screw socket sleeve 17. As further shown in the FIG. 2 embodiment, the lengths of both the handle means 13*a* and the extension member means 15*a* can be adjusted in length and fixed in place by a screw sleeve 19. By increasing or decreasing the length of the extension member means 15*a*, the device 12 can be used to align objects of varying height. In addition, in the FIG. 2 embodiment, the elongated arm 11*a* can be adjusted in length and fixed in place by a screw sleeve 19. By increasing or decreasing the length of the elongated arm 11*a*, the device 12 can be used to align objects of varying length.

Figure 3:
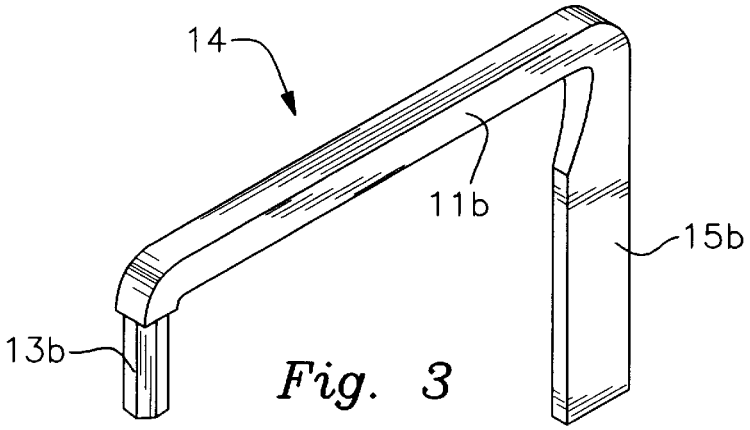
FIG. 3 is a perspective view of the device with varying configurations and dimensions.

Still another embodiment is shown in FIG. 3, which illustrates that neither the configurations nor dimensions for the elongated arm 11*b*, handle means 13*b*, or extension member means 15*b* are required to be the same for the entirety of the device 14.

Figure 4:
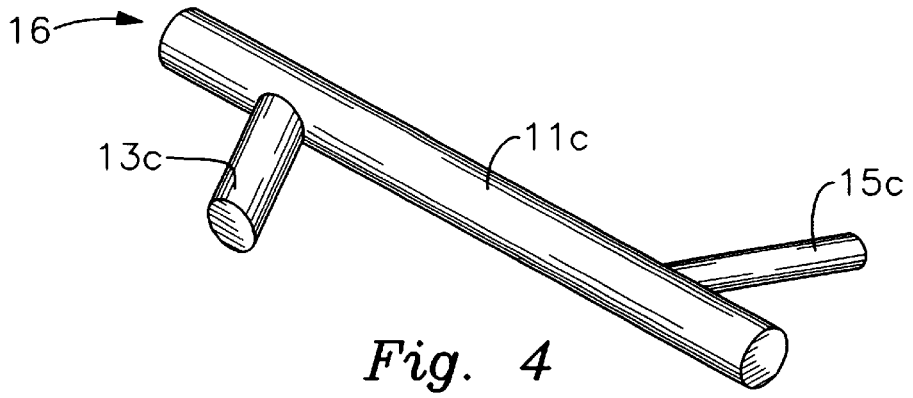
FIG. 4 is a perspective view of the device with the handle means and extension member means attached near the ends of the elongated arm.

In FIG. 4, the handle means 13*c* is disposed near the proximal end of the elongated arm 11*c* of the device 16. The extension member means 15*c* is disposed near the distal end of the elongated arm 11*c* of the device 16. In addition, the handle means 13*c* is not perpendicular to the elongated arm 11*c*. Either the handle means 13*c* or the extension member means 15*c* may be at any angular relationship with respect to the elongated arm 11*c*.

Figure 5:
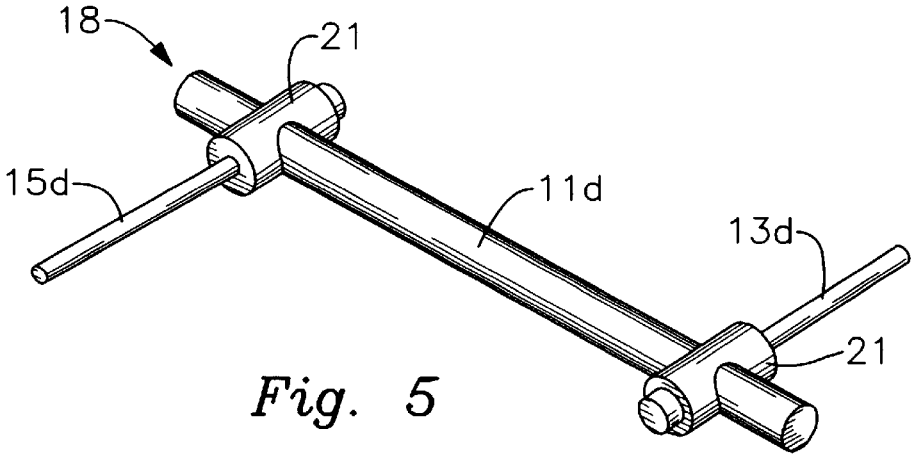
FIG. 5 is a perspective view of the device with the handle means and the extension member means movably attached on the elongated arm.

In the embodiment in FIG. 5, the handle means 13*d* is movably attached by a set screw connector 21 at the proximal end of the elongate arm 11*d*. The extension member means 15*d* is similarly movably attached by a set screw connector 21 at the distal end of the elongate arm 11*d*. Any connection means may be used.

Figure 6:
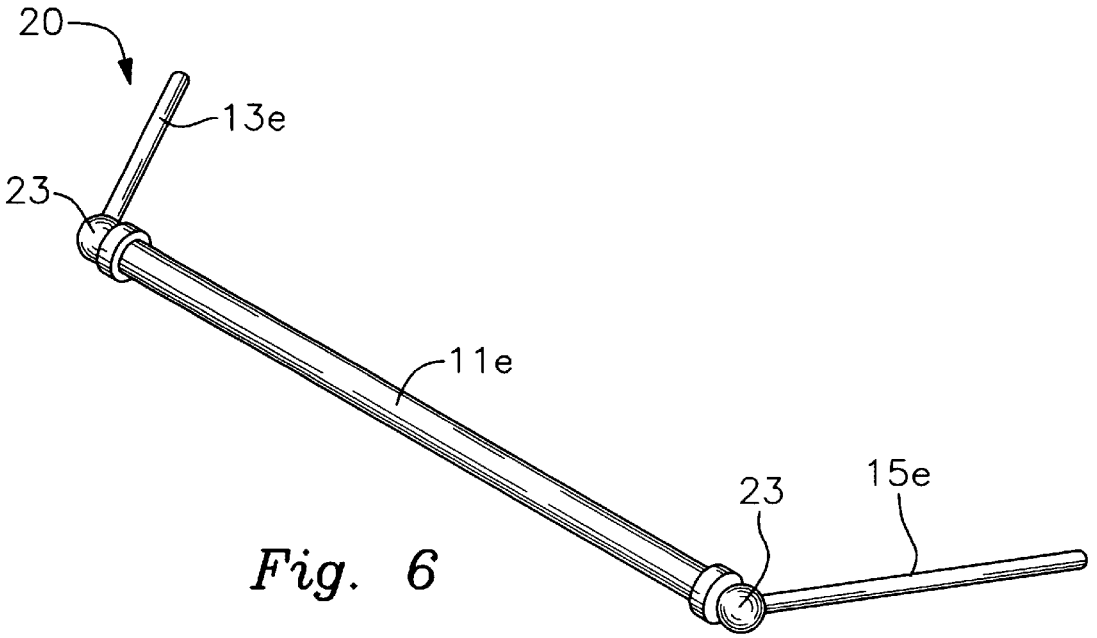
FIG. 6 is a perspective view of the device with the handle means and the extension member means pivotably attached on the elongated arm.

In the FIG. 6, the handle means 13*e* is pivotably attached by a ball and socket joint with screw lock collar connector 23 at the proximal end of the elongate arm 11*e*. The extension member means 15*e* is similarly pivotably attached by a ball and socket joint with screw lock collar connector 23 at the distal end of the elongate arm 11*e*. Any pivotable means may be used.

These embodiments are examples only, the invention is not limited to the details disclosed, but includes all such variations and modifications as fall within the spirit of the invention and the scope of the appended claims.

Figure 7:
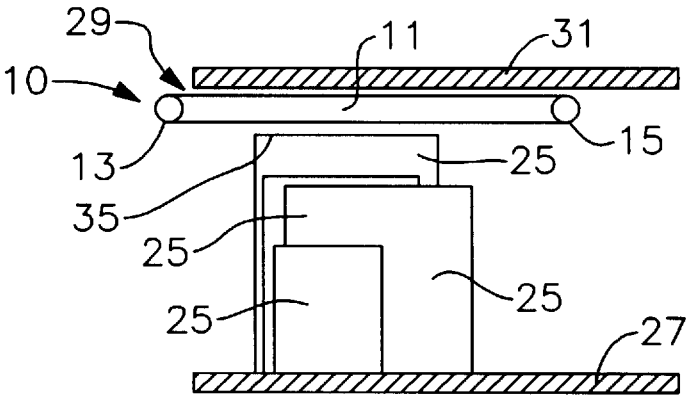
FIG. 7 is a side elevational view of books on a shelf showing use of the device.
Figure 8:
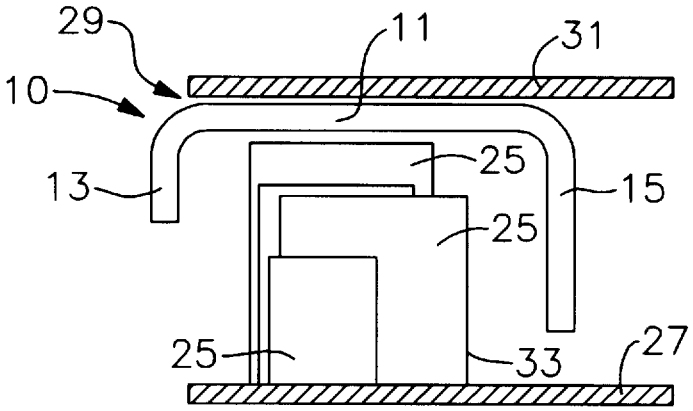
FIG. 8 is a side elevational view of books on a shelf showing use of the device.
Figure 9:
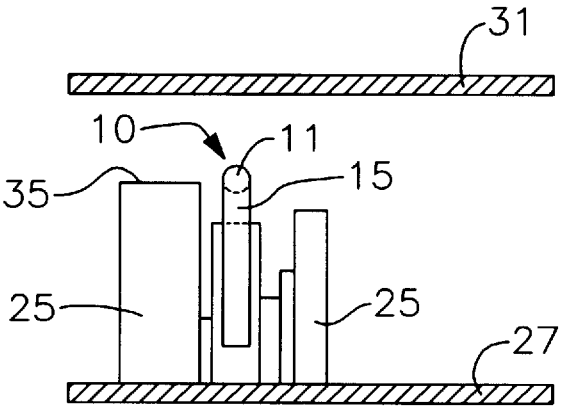
FIG. 9 is a rear elevational view of books on a shelf showing use of the device.

The operation and use of device 10 is described in the following example. Example: For aligning books 25 on a shelf 27 as shown in FIG. 7, orient device 10 so that the extension member means 15 will pass through the space 29 between the books 25 and the upper shelf 31. Insert the device 10 between the books 25 and shelf 31 until the extension member means 15 passes the rear edges 33 of the books 25. Rotate the device 10 until extension member means 15 is able to engage the rear edges 33 of the books 25, as shown in FIGS. 8 and 9, and pull device 10 until the books 25 are aligned. If more than one or two books are to be aligned, then the device 10 is moved so that the extension member means 15 will disengage the rear edges 33 of the books 25 and moved to another section of books 25, and engaging and aligning action repeated. Then move device 10 in the space 29, to a new section of books and repeat the pulling engagement with extension member means 15 with the rear edges 33 until the row of books 25 is aligned. Finally, move the device 10 so that the extension member means 15 will disengage the rear edges 33 of the books 25 and rotate the extension member means 15 so that it is longitudinally horizontal to the top edge 35 of the books 25. Extract the device 10 from space 29.

The use of the invention was found to have unexpectedly and dramatically reduced the amount of time required to align books and other shelf-supported objects such as merchandise and the like.

It will thus be seen that the objects made apparent from the foregoing description are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

The invention claimed is:

1. A device that provides means for aligning a plurality of objects having a plurality of differing heights that are supported by a first horizontally disposed support means that is disposed in parallel, vertically spaced relation to a second horizontally disposed support means where said first and second support means are vertically spaced apart by a predetermined distance that is greater than a maximum height of said differing heights, said predetermined distance being a clearance space, comprising:

an elongated arm of predetermined length having a distal end and a proximal end;

a handle means disposed at the proximal end of the elongated arm in perpendicular, coplanar relation thereto;

an extension means disposed at the distal end of the elongated arm in perpendicular, coplanar relation thereto;

whereby said device is grasped by said handle means, positioned in a horizontal plane, inserted through said clearance space in a first direction, rotated until said extension means is positioned rearwardly of at least one of said objects of said plurality of objects, and displaced in a second direction opposite to said first direction to displace at least one of said objects in said second direction;

whereby said device is then again displaced in said first direction, moved laterally until said extension means is positioned rearwardly of at least a second of said objects of said plurality of objects, and displaced again in said second direction to displace at least said second of said objects; and whereby said procedure is repeated until all of said objects have been brought into alignment with one another.

* * * * *